US006065724A

United States Patent [19]

Arslan et al.

[11] Patent Number: 6,065,724

[45] Date of Patent: May 23, 2000

[54] COMPACT BRACKET FOR SUPPORTING SHELVES

[76] Inventors: Robert Arslan, 341 Gainesboro Rd., Winchester, Va. 22603; Michael Robinson, HCR 61, Box 136, Capon Bridge, W. Va. 26711

[21] Appl. No.: 09/309,518

[22] Filed: May 10, 1999

[51] Int. Cl.[7] ..... A47G 29/02; F16M 13/00; A47B 43/00; A47F 3/00

[52] U.S. Cl. ..... 248/248; 248/223.21; 248/244; 211/187; 211/90.02; 312/140

[58] Field of Search ..... 248/235, 243, 248/244, 245, 246, 247, 248, 223.21, 222.41, 501, 423, 300; 211/187, 90.02; 312/140

[56] References Cited

U.S. PATENT DOCUMENTS

| | | | |
|---|---|---|---|
| 624,723 | 5/1899 | Allis | 248/247 |
| 761,156 | 2/1904 | Fegert | 248/235 |
| 1,055,050 | 3/1913 | Knape | 248/243 |
| 1,276,677 | 8/1918 | Mittleburg | 248/246 |
| 1,393,012 | 10/1921 | Dilg | 248/243 |
| 1,545,016 | 7/1925 | Sessions . | |
| 1,751,463 | 3/1930 | Backus et al. | 248/423 |
| 1,855,245 | 4/1932 | Kuenzel | 248/423 |
| 2,570,731 | 10/1951 | Susnow . | |
| 3,179,367 | 4/1965 | Rapata | 248/223.21 |
| 3,180,606 | 4/1965 | Sabin et al. | 248/223.21 |
| 3,317,167 | 5/1967 | Becker et al. | 248/423 |
| 3,459,396 | 8/1969 | Buttriss . | |
| 3,632,167 | 1/1972 | Sinfield | 248/423 |
| 4,081,057 | 3/1978 | Corradini | 248/223.21 |
| 4,398,647 | 8/1983 | Ackerman | 248/223.21 |
| 4,632,222 | 12/1986 | Chen | 248/222.41 |
| 4,819,901 | 4/1989 | McDonald | 248/243 |
| 5,201,120 | 4/1993 | Patrick | 248/248 |
| 5,348,377 | 9/1994 | Grosch | 248/423 |
| 5,560,418 | 10/1996 | Kissinger | 248/243 |
| 5,740,999 | 4/1998 | Yamada | 248/423 |

FOREIGN PATENT DOCUMENTS

| | | | |
|---|---|---|---|
| 28331910 | 7/1978 | Germany | 248/223.21 |
| 3905863 | 2/1989 | Germany | 248/243 |
| 6404996 | 11/1965 | Netherlands | 248/223.21 |
| 20218 | 1/1898 | United Kingdom | 248/248 |
| 428473 | 11/1933 | United Kingdom | 248/248 |

*Primary Examiner*—Ramon O. Ramirez
*Assistant Examiner*—Jerome A DeLuca
*Attorney, Agent, or Firm*—Terrance L. Siemens

[57] ABSTRACT

A cabinet having brackets disposed to support shelves behind glass panes of the front wall of the cabinet in a location concealed behind one horizontal mullion. The cabinet has at least two other vertical walls having a plurality of pre-drilled screw holes for attaching brackets, and at least one shelf which fits behind the front wall and between the vertical walls. Each bracket is generally L-shaped, having a flat vertical leg bearing a plurality of holes for passing a fastener and a flat horizontal leg for supporting a shelf. The vertical leg has two short extensions projecting beyond the horizontal leg, thereby stabilizing the bracket against tilting responsive to weight being imposed thereon. The horizontal leg has a neck adjoining the vertical leg which enlarges to form a broad head. The head is rounded and is of width no greater than that of the vertical leg. Distal ends of the short extensions and of the main section of the vertical leg are also rounded. In an alternative embodiments, a single elongate fastener hole is provided, the elongate hole configured produced by causing plural circular holes to be linearly arranged and to overlap at least one other circular hole.

17 Claims, 3 Drawing Sheets

FIG. 3
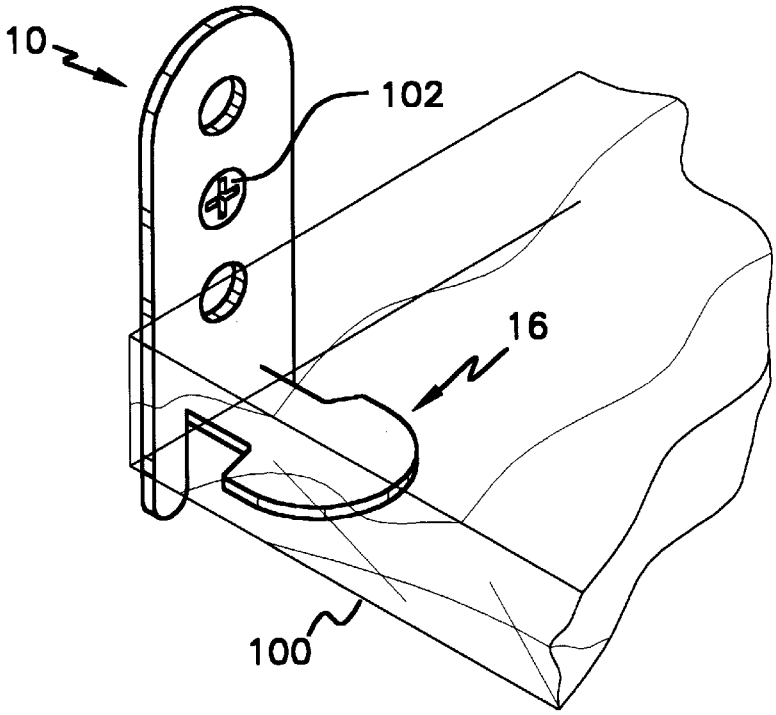
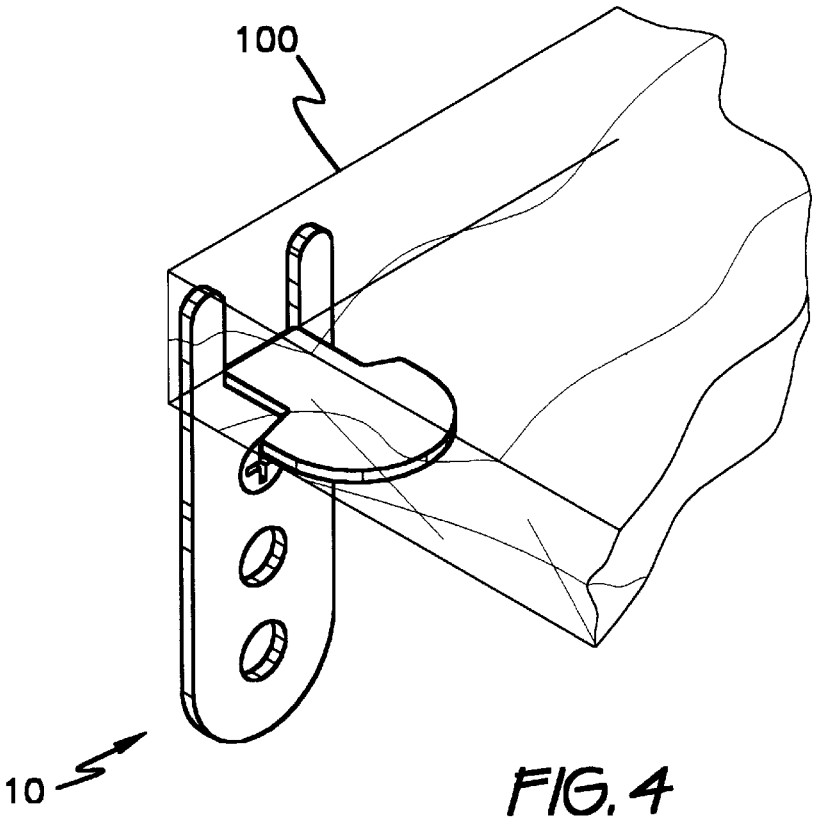
FIG. 4

COMPACT BRACKET FOR SUPPORTING SHELVES

BACKGROUND OF THE INVENTION

1. Field of the Invention

The present invention relates to brackets for mounting shelves to supporting vertical surfaces. The novel bracket finds utility in applications wherein adjustment is required in positioning a shelf relative to the vertical surfaces. Thus the invention is useful to furniture manufactures and to craftsmen and others installing shelves in furniture and directly to walls and the like in buildings and vehicles.

2. Description of the Prior Art

It is frequently desired to mount one or more horizontal shelves to vertical supporting surfaces. When the vertical supporting surface is pre-existing, it is further frequently desirable to position each shelf at a particular location relative to the vertical surfaces. Illustratively, the shelves may be required to be spaced apart vertically from one another by a predetermined distance. When constructing furniture having transparent windows, it becomes strongly desirable for esthetic reasons to align shelves with mullions and frame elements for each window pane.

This may require adjustment of position of brackets intended to support the shelves. This adjustment may require, for example, location of screws or corresponding fasteners very precisely. It would be most helpful to craftsmen assembling the shelves to have the widest possible latitude in locating screws relative to the bracket, so that there are a maximal number of screw positions available when the bracket is located at one point relative to the vertical surface to which it is to be attached.

Such brackets are generally L-shaped. One leg of the L contacts against the vertical supporting surface and has one or more holes to accept a fastener which pins the bracket to the supporting surface. The other leg projects at a right angle to provide a platform on which the shelf is placed. U.S. Pat. No. 5,201,120, issued to Michael E. Patrick on Apr. 13, 1993, illustrates a bracket wherein the leg which contacts the vertical surface has short projections extending beyond the horizontally projecting leg. The present invention differs from the bracket of Patrick in that the horizontally projecting leg in the present invention has a much broader head than those of Patrick. This feature provides superior support surface and stability to a shelf being supported. Also, only one member need be bent during fabrication at a right angle from the original flat configuration of the stock material. Other features are that whereas Patrick has sharp corners, the ends of the short projections and of both vertical and horizontal legs in the present invention are rounded. This feature reduces likelihood of injury during assembly and when reaching into the finished furniture to insert and remove articles being displayed and stored. In a further departure from Patrick, fastener holes are arranged closely spaced apart. Very fine adjustment of position is made possible by close spacing.

L-shaped brackets are also shown in U.S. Pat. No. 1,545,016, issued to Albert L. Sessions on Jul. 7, 1925, 2,570,731, issued to Saul H. Susnow on Oct. 9, 1951, and 3,459,396, issued to Albert T. Buttriss on Aug. 5, 1969. In each case, the subject bracket lacks projections of the vertical leg extending beyond the horizontal leg. This feature steadies the bracket by altering the fulcrum which may be said to exist when weight imposed on the bracket would tend to cause the bracket to pivot such that the vertical leg would pivot away from contact with the vertical supporting surface. Susnow includes an elongated hole for receiving a fastener. However, this differs from the present invention in that should a fastener become loose, the bracket could drop relative to that fastener. By contrast, in the present invention, such movement is precluded by interference between the fastener hole or holes and the fastener.

None of the above inventions and patents, taken either singly or in combination, is seen to describe the instant invention as claimed.

SUMMARY OF THE INVENTION

The present invention sets forth a bracket which is highly suited for assembling shelves within cabinets, although it may obviously be employed in other settings. The novel bracket is configured to provide a maximal number of possible positions of adjustment of location along a vertical surface, while simultaneously being of compact size. This feature renders it unobtrusive, which is very desirable when utilized in constructing cabinets, display cases, china closets, and the like which have transparent windows. The many positions of adjustment arise from providing many closely spaced or overlapping holes for receiving fasteners. Lack of a single elongated hole with straight sides precludes the bracket from falling should a fastener become loose but not fully disengage from the vertical supporting surface.

Other features of the invention include provision of short extensions of the vertical leg which project beyond the horizontal leg. These extensions stabilize the bracket by altering the fulcrum which exists when weight imposed on the bracket would tend to cause the bracket to pivot such that the vertical leg pivots away from contact with the vertical supporting surface. The short extensions are located in bilateral symmetry with respect to the horizontal leg.

A further feature of the novel bracket is that the relatively broad head of the horizontal leg maximizes area of that leg, which feature promotes secure engagement of a shelf with the underlying supporting surface of the bracket. This is particularly useful if the shelf is not built with extreme precision, and there is space between the shelf and the rear and right and left lateral walls of the cabinet. The broad head maximizes area of the horizontal leg, while minimizing overall area of the bracket.

In assembling pre-fabricated cabinets and the like, the novel bracket allows for fine adjustment even when employing linearly arrayed, widely spaced, pre-drilled screw holes. The person assembling the cabinet can select an appropriate location and fastener hole in the bracket to assure that a shelf will be concealed behind a mullion. Should a consumer subsequently relocate one or more shelves, no new holes need be drilled. It is merely necessary to drive a fastener into a newly selected existing hole.

The novel bracket can be reversed. That is, the vertical leg can project either upwardly or downwardly, thereby doubling the total number of positions of adjustment available from the number of fastener holes.

In an alternative embodiment of the invention, fastener holes overlap, thereby further increasing the number of positions of the bracket when a fastener is driven into one screw hole in the cabinet. Vertical movement of the bracket relative to its supporting vertical wall of the cabinet is precluded because portions of the bracket surrounding the fastener hole cause interference with the shaft of the fastener. This is an improvement over prior art brackets having elongated holes characterized by straight sides.

The invention may also be regarded as a combination of the novel bracket together with furniture and other constructed objects assembled with one or more novel brackets. Cabinets in particular, but also any furniture or construction having two vertical surfaces disposed at any non-parallel angle to one another may employ the novel brackets to support shelves. In particular, a cabinet having mullion doors including horizontal mullions and an array of vertically and regularly spaced apart, pre-drilled screw holes is afforded a great many positions for mounting each shelf such that the shelf may be concealed behind a horizontal mullion. This avoids spoiling the appearance of fine finished furniture having transparent windows, which result would otherwise occur if a shelf were not concealed by alignment with a mullion. A further benefit of cabinetry so constructed is that an owner may subsequently reposition shelves and still be able to conceal each shelf behind a mullion.

Accordingly, it is one object of the invention to provide a bracket for supporting a shelf on a vertical environmental surface, which bracket affords a plurality of closely spaced mounting positions of the shelf relative to the environmental surface.

It is another object of the invention to stabilize the bracket on the vertical supporting surface when weight imposed on the bracket would otherwise tend to urge the bracket out of contact with the supporting surface.

It is a further object of the invention to preclude injury from sharp edges and corners formed in the bracket.

Still another object of the invention is to maximize area of that leg of the bracket supporting the shelf, while minimizing overall area of the bracket.

An additional object of the invention is to enable cabinetry having transparent windows with mullions to have shelves adjustably located thereon such that the shelves are concealed by alignment with the mullions.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 3 is a perspective view of a shelf supported on the bracket of FIG. 1.

FIG. 4 is a perspective view similar to FIG. 3, illustrating a reversed position of the bracket.

DETAILED DESCRIPTION OF THE PREFERRED EMBODIMENTS

Figure 1:
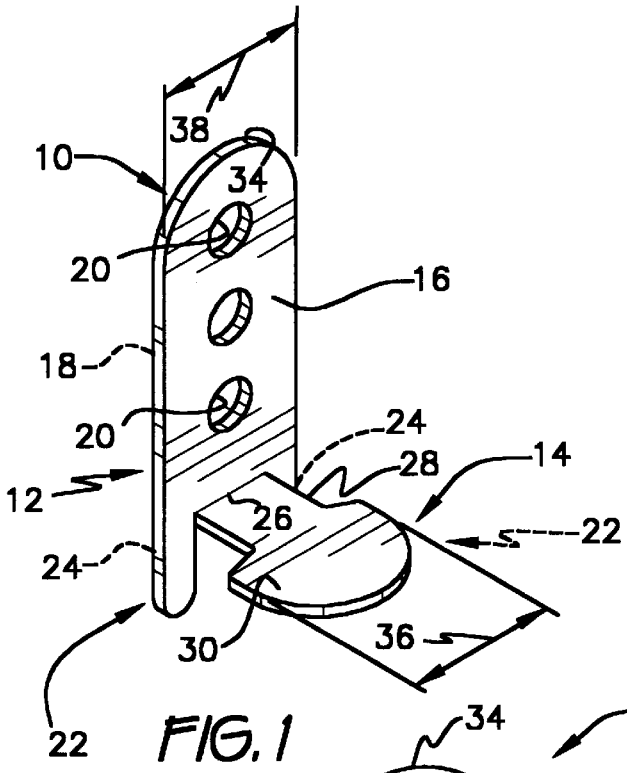
FIG. 1 is a perspective view of a novel bracket.

FIG. 1 of the drawings shows basic construction of a novel bracket 10. Bracket 10 is generally L-shaped, having a vertical leg 12 and a horizontal leg 14. Designation of "vertical" and "horizontal" are for semantic convenience only, and describe bracket 10 as it would be oriented in normal usage affixed to a vertical surface. Vertical leg 12 has a main or principal section 16 characterized by a flat rear surface 18 and bearing a plurality of holes 20 each for passing the shaft of a fastener such as a screw (not shown) therethrough.

In the embodiment of FIG. 1, adjacent holes 20 are arrayed longitudinally along main section 16 vertical leg 12, with each two adjacent said holes spaced apart by a distance of magnitude less than or equal to that of the minimum diameter of either hole 20. In this respect, holes 20 may be said to be closely spaced apart. Vertical leg 12 has two short extensions 22 (see also FIG. 2) each having a flat rear surface 24 which is coplanar with surface 18.

Figure 2:
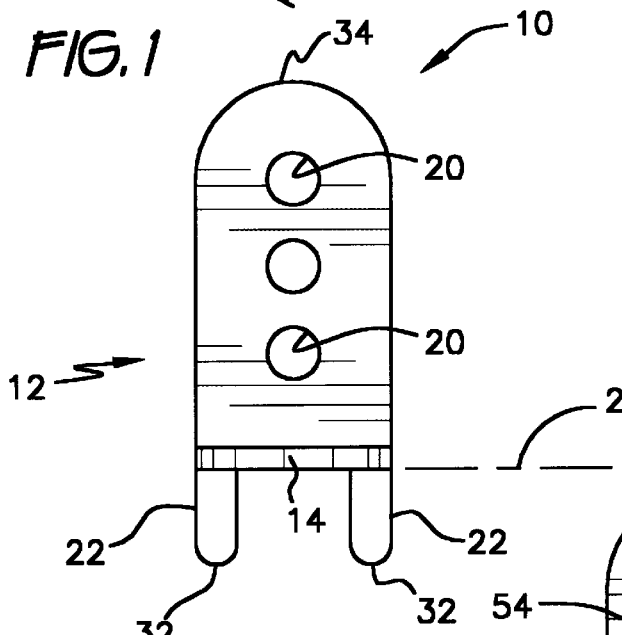
FIG. 2 is a front elevational view of the novel bracket.

A joint 26 is defined between vertical leg 12 and horizontal leg 14 and said vertical leg. FIG. 2 indicates the location of the joint by extension line 26A. Again referring to FIG. 1, extensions 22 are disposed upon one side of joint 26, and main section 16 of vertical leg 12 is disposed at the other side of joint 26.

Horizontal leg 14 is seen to comprise a neck 28 adjoining vertical leg 12 at joint 26. Neck 28 enlarges to form a broad head 30. Broad head 30 is rounded, as are the distal ends 32 (see FIG. 2) of extensions 22 and distal end 34 of main section 16 of vertical leg 12. Rounding of these parts of bracket 10 assures that they be devoid of sharp corners.

Extensions 22 are located in bilateral symmetry with respect to neck 28 of horizontal leg 14. This arrangement assures maximal stability of bracket 10 when it is affixed to a supporting vertical surface (see FIG. 6) and weight is imposed thereon. This characteristic also enables bracket 10 to be employed in a position inverted from that shown in FIG. 1, as will be described hereinafter with reference to FIGS. 3 and 4.

Width of head 30, indicated at 36, is less than or equal to the width (indicated at 38) of main section 16 of vertical leg 12. The features described above enable bracket 10 to be fabricated from a flat strip of material of uniform width while still affording the recited features and benefits.

FIG. 3 shows how a shelf 100 is supported on a bracket 10. Bracket 10 is attachable to a supporting structure (not shown) having a vertical surface by passing the shaft of a fastener such as screw 102 through one hole 20. Shelf 100 may then be laid down onto horizontal leg 16 of bracket 10. Because surfaces 18 and 24 are flat and coplanar, bracket 10 may be inverted from the position shown in FIG. 3. The inverted position is shown in FIG. 4. It will be seen from examining FIGS. 3 and 4 that any hole 20 may be selected to affix bracket 10 to the vertical supporting surface. It then follows that in embodiments of the invention wherein three holes 20 are provided, six mounting positions of bracket 10 are possible utilizing the same screw hole receiving screw 102. That is, bracket may be raised or lowered so that screw 102 may pass through a different hole 20 when screw 102 engages a particular screw hole (see FIG. 6) pre-drilled into the supporting surface. A second set of three positions are possible when bracket 10 is inverted.

The embodiment of FIG. 1 provides a plurality of separate holes 20. The plurality of holes 20 assures that a plurality of closely spaced apart shoulders are provided, where the shoulders comprise those portions of the circumference of each hole 20 which circumference would cause interference in direct shear with the shaft of the fastener passed through that hole 20, assuming that there is reasonably close fit between a hole 20 and fastener, as is conventional.

Figure 5:
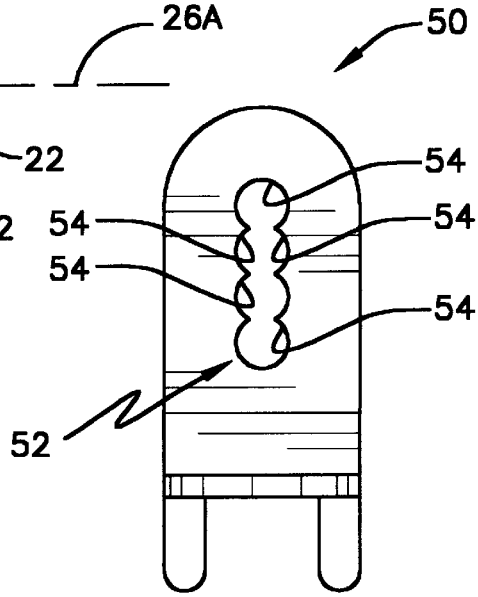
FIG. 5 is a front elevational view of an alternative embodiment of the novel bracket.

FIG. 5 shows an alternative embodiment of the invention wherein a bracket 50 which is in other ways equivalent to bracket 10 of FIG. 1 has a single elongate hole 52 rather than the plurality of spaced apart holes 20 of the embodiment of FIG. 1. Hole 20 has a configuration produced by causing plural circular holes to be linearly arranged and wherein each circular hole overlaps at least one other circular hole. Thus single hole 20 has a plurality of shoulders 54 which operate to entrap the shaft of a close fitting fastener in a manner substantially similar to that arising from the spaced apart holes 20 of FIG. 1. However, spacing of fastener positions even denser than that afforded by spaced apart holes 20 is made possible by the embodiment of FIG. 5.

Figure 6:
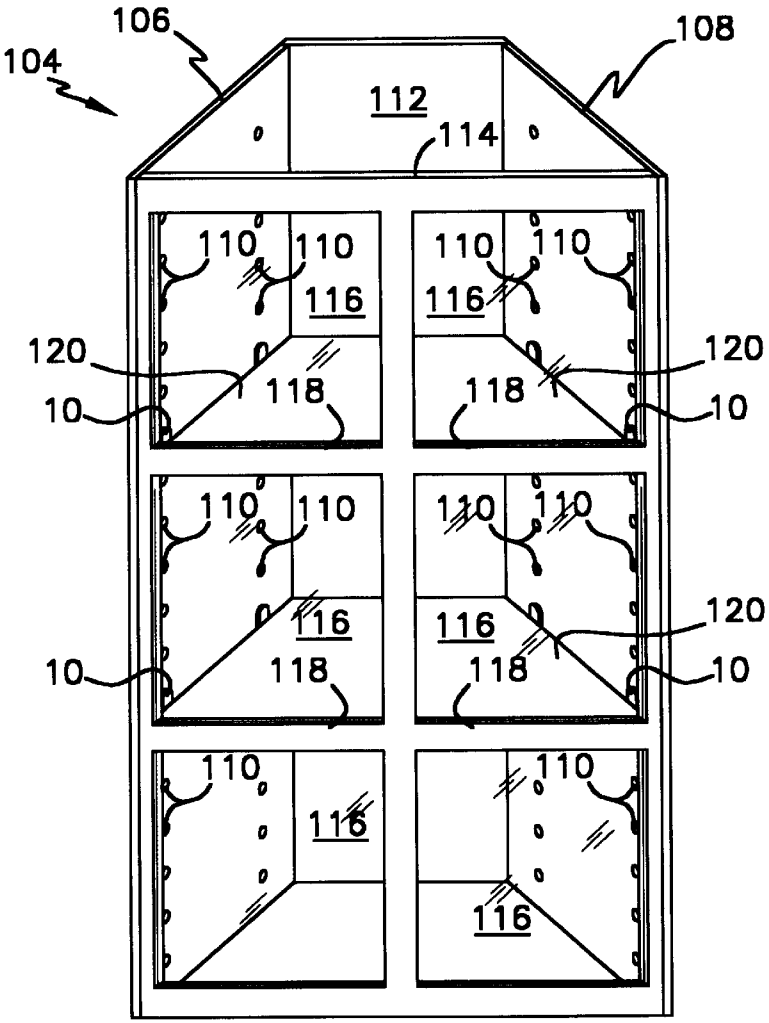
FIG. 6 is a perspective view of a cabinet incorporating the novel bracket.

FIG. 6 shows cooperation between bracket 10 (cooperation is equally applicable to bracket 50) and an article of furniture for storing and displaying objects, such as cabinet 104. Cabinet 104 has at least two vertical walls 106, 108 each bearing a plurality of pre-drilled screw holes 110. In most cases, cabinets are parallelepipeds having a rear wall 112. Of course, the inventive concept is equally applicable to furniture of other configurations, such as, for example, triangular furniture intended to occupy corners of rooms.

The present invention is most advantageously employed with cabinets having a front wall 114 having a plurality of transparent windows such as glass panes 116. Front wall 114 may be fixed in place, or may comprise a single or double hinged door or panel, or any combination of these. Each two vertically adjacent panes 116 are separated by a horizontal mullion 118. In the field of display cabinets, the term "mullion" will be understood to apply to horizontal as well as vertical members separating panes 116. Cabinet 104 has shelves 120 dimensioned and configured to occupy space behind front wall 114 and between walls 106, 108.

Each shelf 120 is supported by a plurality of brackets 10 (or brackets 50, not illustrated in FIG. 6). Brackets 10 (and 50) are small and unobtrusive, and perform their intended task suitably without significantly degrading aesthetics of cabinet 104.

Figure 7:
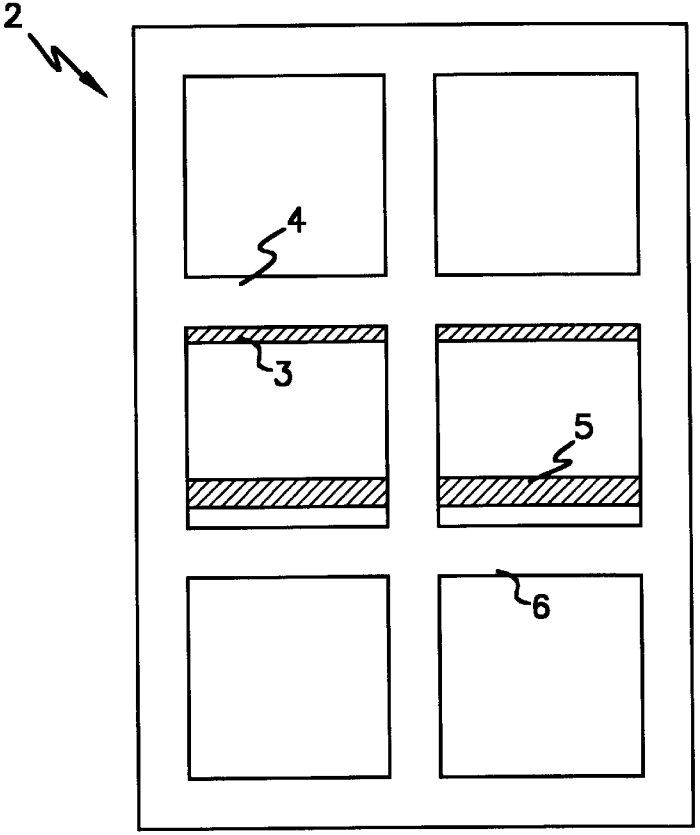
FIG. 7 (PRIOR ART)
FIG. 7 is a front elevational view of a prior art cabinet, illustrating the problem solved by the invention.

FIG. 7 illustrates the problem solved by the present invention. In a typical prior art cabinet 2, shelf 3 is partially visible behind mullion 4. In an even more extreme example, the full front surface of shelf 5 is fully visible behind mullion 6. Locations and visibility of shelves 3 and 5 may be unavoidable in a prior art cabinet wherein pre-drilled screw holes corresponding to holes 20 of FIG. 6 are not carefully coordinated with location of mullions 4 and 6, particularly in those instances wherein vertical spacing of screw holes is relatively great. The present invention addresses this shortcoming in the prior art by enabling the six positions of a shelf possible when utilizing only one screw hole height, as described with reference to FIG. 1. Of course, still additional positions are afforded by bracket 50 of embodiment of FIG. 5.

It is to be understood that the present invention is not limited to the embodiments described above, but encompasses any and all embodiments within the scope of the following claims.

I claim:

1. A bracket attachable to a vertical surface by a fastener having a shaft, comprising:

a vertical leg having a main section having a flat rear surface, width, and bearing at least one hole for passing a fastener therethrough, said at least one hole having a plurality of closely spaced apart shoulders disposed to cause interference in direct shear with the shaft of the fastener, and at least one short extension having a flat rear surface which is coplanar with said rear surface of said main section; and a horizontal leg projecting from said vertical leg, there being a joint defined between said horizontal leg and said vertical leg, wherein said at least one short extension of said vertical leg is disposed on one side of said joint and said main section of said vertical leg is disposed on the other side of said joint, and wherein said horizontal leg has a neck adjoining said vertical leg and wherein said neck enlarges to form a broad head having a width, and wherein width of said main section of said vertical leg is at least equal in magnitude to that of said width of said broad head.

2. The bracket according to claim 1, wherein said main section of said vertical leg has a rounded distal end devoid of sharp corners.

3. The bracket according to claim 1, wherein said short extensions of said vertical leg have rounded distal ends devoid of sharp corners.

4. The bracket according to claim 1, wherein said broad head of said horizontal leg has a rounded distal end devoid of sharp corners.

5. The bracket according to claim 1, wherein said vertical leg has two said short extensions located in bilateral symmetry with respect to said horizontal leg.

6. The bracket according to claim 1, wherein said horizontal leg is flat.

7. The bracket according to claim 1, wherein said at least one hole comprises a plurality of holes arrayed longitudinally along said main section of said vertical leg, wherein each two adjacent said holes are spaced apart by a distance of magnitude less than that of the minimum diameter of either said hole.

8. The bracket according to claim 1, wherein said at least one hole has a configuration produced by causing plural circular holes to be linearly arranged and wherein each said circular hole overlaps at least one other said circular hole.

9. A bracket attachable to a vertical surface by a fastener having a shaft, comprising:

a flat vertical leg having a main section having a flat rear surface and a rounded distal end, width, and bearing at least one hole for passing a fastener therethrough, having a plurality of closely spaced apart shoulders disposed to cause interference in direct shear with the shaft of the fastener, and two short extensions each having a flat rear surface which is coplanar with said rear surface of said main section, and a rounded distal end; and a flat horizontal leg projecting from said vertical leg, there being a joint defined between said horizontal leg and said vertical leg, wherein said short extensions of said vertical leg are disposed on one side of said joint and said main section of said vertical leg is disposed on the other side of said joint, and wherein said horizontal leg has a neck adjoining said vertical leg, wherein said neck enlarges to form a rounded broad head having a width, wherein width of said main section of said vertical leg is at least equal in magnitude to that of said width of said broad head, and wherein said short extensions of said vertical leg are located in bilateral symmetry with respect to said horizontal leg.

10. The bracket according to claim 9, wherein said at least one hole comprises a plurality of holes arrayed longitudinally along said main section of said vertical leg, wherein each two adjacent said holes are spaced apart by a distance of magnitude less than that of the minimum diameter of either said hole.

11. The bracket according to claim 9, wherein said at least one hole has a configuration produced by causing plural circular holes to be linearly arranged and wherein each said circular hole overlaps at least one other said circular hole.

12. An article of furniture for storing and displaying objects on at least one shelf fixed to said article of furniture with fasteners each having a shaft, comprising:

a first vertical wall bearing a plurality of screw holes;

a second vertical wall bearing a plurality of screw holes;

a front wall having a plurality of transparent windows wherein each two vertically adjacent said windows are separated by a mullion;

a shelf dimensioned and configured to occupy space between said first vertical wall, said second vertical wall, and said front wall; and a plurality of brackets for supporting said shelf behind said front wall on said first vertical wall and said second vertical wall, wherein each said bracket comprises a vertical leg having a main section including a flat rear surface, width, and bearing at least one hole for passing the shaft of a fastener therethrough, said at least one hole having a plurality of closely spaced apart shoulders disposed to cause interference in direct shear with the shaft of the fastener, wherein said vertical leg also has at least one short extension having a flat rear surface which is coplanar with said rear surface of said main section of said vertical leg, and a horizontal leg projecting from said vertical leg, there being a joint defined between said horizontal leg and said vertical leg, wherein said at least one short extension of said vertical leg is disposed on one side of said joint and said main section of said vertical leg is disposed on the other side of said joint, and wherein said horizontal leg has a neck adjoining said vertical leg and wherein said neck enlarges to form a broad head having a width, and wherein width of said main section of said vertical leg is at least equal in magnitude to that of said width of said broad head.

13. The article of furniture according to claim 12, wherein said main section of said vertical leg of said horizontal leg of at least one said bracket has a rounded distal end devoid of sharp corners, said short extensions of said vertical leg of at least one said bracket have rounded distal ends devoid of sharp corners, and said broad head of said horizontal leg of at least one said bracket has a rounded distal end devoid of sharp corners.

14. The article of furniture according to claim 12, wherein said vertical leg of at least one said bracket has two said short extensions located in bilateral symmetry with respect to said horizontal leg.

15. The article of furniture according to claim 12, wherein said horizontal leg of each said bracket is flat.

16. The article of furniture according to claim 12, wherein said at least one hole formed in each said bracket for passing the shaft of a fastener therethrough comprises a plurality of holes arrayed longitudinally along said main section of said vertical leg of each said bracket, wherein each two adjacent said holes are spaced apart by a distance of magnitude less than that of the minimum diameter of either said hole.

17. The article of furniture according to claim 12, wherein said at least one hole formed in each said bracket has a configuration produced by causing plural circular holes to be linearly arranged and wherein each said circular hole overlaps at least one other said circular hole.

* * * * *